FIP7912 XR 4,046,195

United States Patent [19]

Cram et al.

[11] 4,046,195

[45] Sept. 6, 1977

[54] THERMAL RECOVERY OF HYDROCARBONS FROM TAR SANDS

[75] Inventors: Phillip J. Cram, Calgary; David A. Redford, Fort Saskatchewan, both of Canada

[73] Assignee: Texaco Exploration Canada Ltd., Calgary, Canada

[21] Appl. No.: 588,125

[22] Filed: June 18, 1975

[51] Int. Cl.[2] ..... E21B 43/24

[52] U.S. Cl. ..... 166/272; 166/273

[58] Field of Search ..... 166/272, 273, 261

[56] References Cited

U.S. PATENT DOCUMENTS

| | | | |
|---|---|---|---|
| 2,818,117 | 12/1957 | Koch | 166/256 |
| 3,170,515 | 2/1965 | Willman | 166/261 |
| 3,196,945 | 7/1965 | Craig, Jr. et al. | 166/261 |
| 3,366,176 | 1/1968 | Parrish | 166/272 X |
| 3,409,077 | 11/1968 | Durie | 166/256 |
| 3,512,585 | 5/1970 | Allen | 166/272 X |
| 3,587,739 | 6/1971 | Parker | 166/261 |

*Primary Examiner*—Stephen J. Novosad
*Assistant Examiner*—George A. Suchfield
*Attorney, Agent, or Firm*—Thomas H. Whaley; Carl G. Ries; Charles L. Bauer

[57] ABSTRACT

A method for the recovery of low API gravity viscous oils or bitumen from a subterranean formation by the injection of steam followed by a mixture of an oxygen-containing gas and steam until an optimum amount of gas has been injected, followed by injection of steam alone.

7 Claims, 1 Drawing Figure

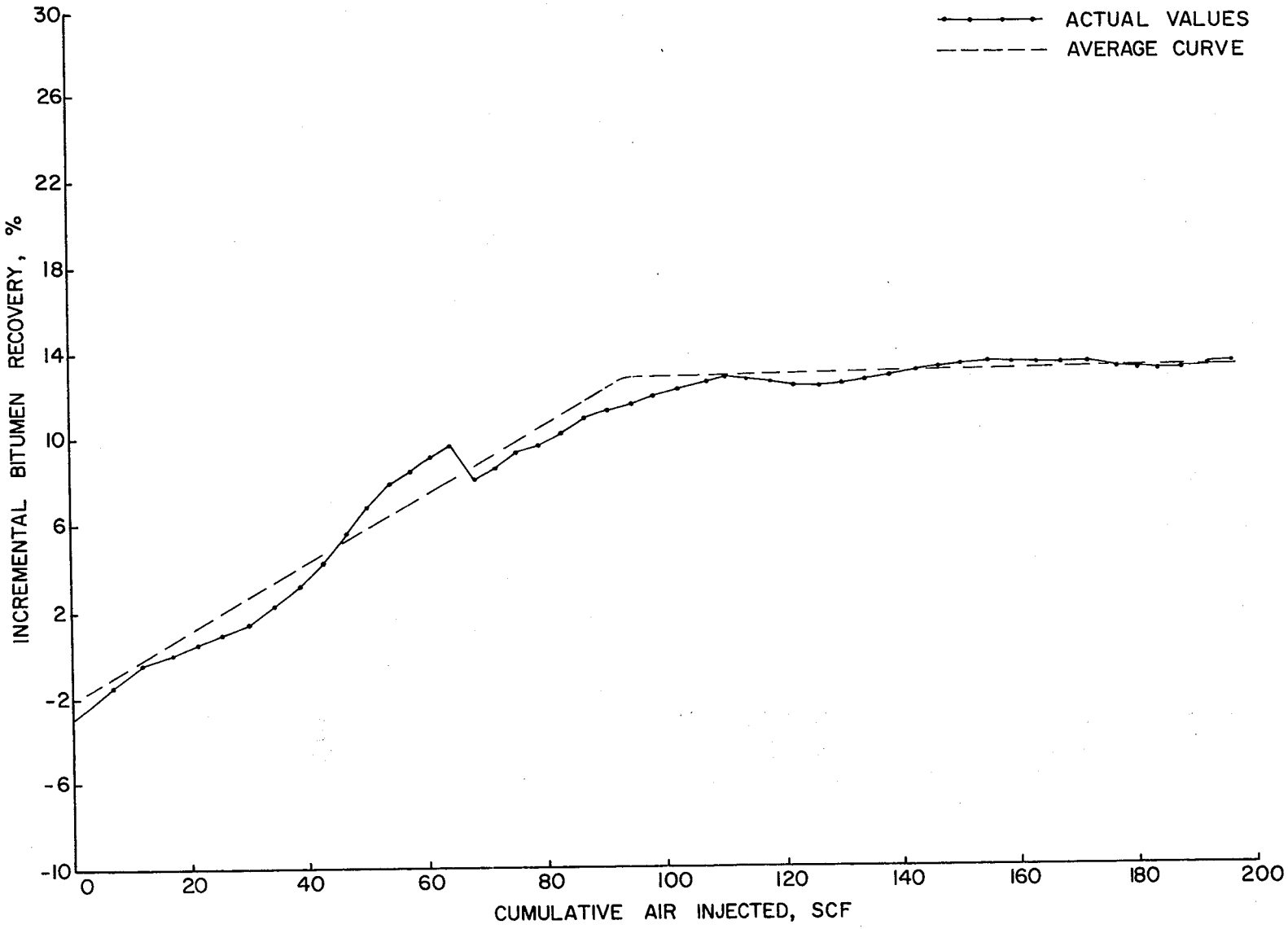
ACTUAL VALUES
AVERAGE CURVE
INCREMENTAL BITUMEN RECOVERY, %
30
26
22
18
14
10
6
2
-2
-6
-10
0
20
40
60
80
100
120
140
160
180
200
CUMULATIVE AIR INJECTED, SCF

THERMAL RECOVERY OF HYDROCARBONS FROM TAR SANDS

BACKGROUND OF THE INVENTION

The present invention relates to an improved method for the recovery of oil from subterranean hydrocarbon-bearing formations containing low API gravity viscous oils or bitumen. More particularly, the invention relates to the production of bitumen and hydrocarbons from reservoirs of low mobility, such as tar sand formations.

The recovery of viscous oils from formations and bitumen from tar sands has generally been difficult. Although some improvement has been realized in stimulating recovery of heavy oils, i.e., oil having an API gravity in the range of 10° to 25° API, little, if any, success has been realized in recovering bitumen from tar sands. Bitumen can be regarded as highly viscous oils having a gravity in the range of about 5° to 10° API and contained in an essentially unconsolidated sand referred to as tar sands.

Vast quantities of tar sands are known to exist in the Athabasca region of Alberta, Canada. While these deposits are estimated to contain several hundred billion barrels of oil or bitumen, recovery therefrom using conventional in-situ techniques has not been too successful. The reasons for the lack of success relate principally to the fact that the bitumen is extremely viscous at the temperature of the formation, with consequent low mobility. The viscosity of the tar sands from the Athabasca deposits, for example, is in the range of several million centipoise at the average formation temperature of about 40° F, so that the bituminous petroleum is essentially immobile at formation temperature. In addition, these tar sand formations have very low permeability, despite the fact they are unconsolidated.

Since it is known that the viscosity of oil decreases markedly with an increase in temperature, thereby improving its mobility, thermal recovery techniques have been investigated for recovery of bitumen from tar sands. These thermal recovery methods generally include steam injection, hot water injection and in-situ combustion.

Typically, such thermal techniques employ an injection well and a production well traversing the oil-bearing or tar sand formation. In a steam operation employing two wells, steam is introduced into the formation through the injection well. Upon entering the formation, the heat transferred by the hot fluid functions to lower the viscosity of oil, thereby improving its mobility, while the flow of the hot fluid functions to drive the oil toward the production well from which it is produced.

In the conventional forward in-situ combustion operation, an oxygen-containing gas, such as air, is introduced into the formation via a well, and combustion of the in-place crude adjacent the wellbore is initiated by one of many known means, such as the use of a downhole gas-fired heater or downhole electric heater or chemical means. Thereafter, the injection of the oxygen-containing gas is continued so as to maintain a combustion front which is formed and to drive the front through the formation toward the production well.

As the combustion front advances through the formation, a swept area consisting, ideally, of a clean sand matrix is created behind the front. Ahead of the advancing front various contiguous zones are built up that also are displaced ahead of the combustion front. These zones may be envisioned as a distillation and cracking zone, a condensation and vaporization zone, an oil bank and a virgin or unaltered zone.

The temperature of the combustion front is generally in the range of 750°–1100° F. The heat generated in this zone is transferred to the distillation and cracking zone ahead of the combustion front where the crude undergoes distillation and cracking. In this zone a sharp thermal gradient exists wherein the temperature drops from the temperature of the combustion front to about 300°–450° F. As the front progresses and the temperature in the formation rises, the heavier molecular weight hydrocarbons of the oil become carbonized. These coke-like materials are deposited on the matrix and are the potential fuel to sustain the progressive in-situ combustion.

Ahead of the distillation and cracking zone is a condensation and vaporization zone. This zone is a thermal plateau and its temperature is in the range of from about 200° F to about 450° F, depending upon the pressure and the distillation characteristics of the fluids therein. These fluids consist of water and steam and hydrocarbon components of the crude.

Ahead of the condensation and vaporization zone is an oil bank which forms as the in-situ combustion progresses and the formation crude is displaced toward the production well. This zone of high oil saturation contains not only reservoir fluids, but also condensate, cracked hydrocarbons and gaseous products of combustion which eventually reach the production well from which they are produced.

Various improvements relating to in-situ combustion are described in the prior art that relate to the injection of water, either simultaneously or intermittently with the oxygen-containing gas, to scavenge the residual heat in the formation behind the combustion front, thereby increasing recovery of oil. Prior art also discloses regulating the amount of water injected so as to improve conformance or sweep efficiency.

Experience has generally shown that these conventional thermal techniques have not been altogether successful when applied to the recovery of heavy oils or bitumen. Where the hydrocarbons sought to be produced have a low API gravity, the build-up of the oil bank ahead of the thermal front occurs to a great extent. Since the heat transfer is low ahead of the front, these heavy hydrocarbons become cool and hence immobile, thereby causing plugging of the formation with the result that the injection of either air in the case of in-situ combustion, or steam in the case of steam, is no longer possible.

The problems recited above become compounded when these techniques are applied to the tar sands not only because of the very low API gravity and very high viscosity of the bitumen, but also because of the very low permeability of the tar sand formations.

Accordingly, it is an object of the present invention to provide an improved thermal recovery method whereby both highly viscous, low-gravity crude oils and bitumen can be recovered more efficiently. The instant invention accomplishes this recovery of heavy oils and bitumen by utilizing thermal methods of steam injection, followed by injection of an oxygen-containing gas and steam, followed by steam injection alone.

SUMMARY OF THE INVENTION

This invention relates to an improved method of recovering low API gravity, viscous oils, and more particularly to the production of bitumen from tar sands by the injection of steam, followed by the injection of a mixture of an oxygen-containing gas and steam until an optimum amount of gas has been injected, followed by the injection of steam alone.

BRIEF DESCRIPTION OF THE FIGURE

The FIGURE shows the relationship between the incremental bitumen recovery and the cumulative air injected.

DESCRIPTION OF THE PREFERRED EMBODIMENT

We have found that improved recovery of viscous or low API gravity petroleum and bitumen from tar sands can be obtained by utilizing the steps of injection of steam, injection of a mixture of an oxygen-containing gas and steam followed by the injection of steam. The injection of the oxygen-containing gas with the steam is commenced after fluid communication has been realized by the injection of steam alone. The injection of the oxygen-containing gas is continued until an optimum value of gas has been injected, after which the injection of the gas is terminated and injection of steam is continued.

In the copending and coassigned application, Ser. No. 481,581 filed June 21, 1974, there is disclosed a method for the recovery of heavy oils or bitumen by the injection of a mixture of an oxygen-containing gas and steam at a temperature corresponding to the saturation temperature of steam for the pressure of the formation, whereby low temperature oxidation or controlled combustion is established and maintained in-situ in a temperature range of 250°–500° F to enhance the recovery of petroleum.

We have now determined that the improved recovery of bitumen can be realized by injecting the mixture of an oxygen-containing gas and steam and terminating the injection of the oxygen-containing gas after an optimum amount of the gas has been injected with the steam.

To illustrate this invention, a series of laboratory tests were performed using a tar sand from the McMurray formation in Alberta, Canada. For each test approximately 190 pounds of tar sand were packed in a cell approximately 15 inches long and 18 inches in diameter. The cell was equipped for operating at controlled temperatures up to 420° F and pressures of 500 psi, and contained simulated suitable injection and production wells. In addition, the cell contained many thermocouples so that both temperatures could be measured and heat transfer rates throughout the cell could be calculated.

In the runs the pressure of the cell was maintained at 300 psi during the test. Initially fluid communication was established by the injection of air; thereafter steam was injected until breakthrough.

In the first run, steam was injected at 300 psig and at a temperature of approximately 417° F until breakthrough occurred at the production well. Thereafter, steam injection was continued for about 14.5 hrs. Production cycles, which consisted of 20 minutes of steam injection followed by 10 minutes drain, were carried out for a further 15.0 hours. With the initial breakthrough of the steam, a large amount of unemulsified bitumen was produced. Thereafter, production was principally an oil-in-water emulsion. The recovery of bitumen from this run was about 41%.

In a second run, steam was injected at 300 psig and a temperature of about 417° F for approximately 14.5 hours after breakthrough at the production well, which occurred in approximately 6.7 hours. Thereafter, air was injected simultaneously with the steam in a ratio of about 1 SCF of air to 1 pound of steam. Production cycles were also used wherein a mixture of steam and air was injected for 20 minutes, followed by a drain or draw-down cycle of 10 minutes for approximately 3⅜ hours. The recovery of bitumen from this run was about 55%.

The results from these runs are shown in the accompanying figure in which the incremental bitumen recovery, i.e. the difference between recovery of Runs 2 and 1 above, is plotted against the cumulative cubic feet of air (oxygen-containing gas) injected with the steam. It can be seen the incremental recovery for the air-steam injection increased approximately linearly with air injection up to a total of about 90–95 SCF of air injected and thereafter the incremental recovery was approximately constant as shown by the average curve. The amount of steam injected with the air at this point was approximately 4.0 pore volumes of liquid water equivalent. Thereafter, little additional benefit was observed by the continued simultaneous injection of air with the steam.

The results show that bitumen production can be more efficiently realized when utilizing a steam and oxygen-containing gas injection scheme, if the injection of the oxygen-containing gas is terminated after an optimum amount of the oxygen-containing gas has been injected with the steam.

Tests have indicated that an optimum range for the injected oxygen-containing gas is from 80 to 120 SCF of air or about 140 to 200 pore volumes of gas at standard conditions since 0.580 SCF air occupies about one pore volume of the test cell. At average cell conditions for the experimental run, about 300 psi and 300° F, 1 SCF of air is compressed to about 0.067 cubic feet. Thus, the optimum air range for the oxygen-containing gas is from about approximately 9 to 14 pore volumes of gas at the reservoir conditions of 300 psi and 417° F.

The results further indicated that gas can be made to flow through a tightly packed bed of tar sand, and also that the injection of a mixture of an oxygen-containing gas and steam, wherein the gas injected is optimized, results in increased recovery as compared with steam alone.

It is postulated that the injection of the steam alone provides the requisite heat to the bitumen to render it more mobile and therefore more easily produced. Thereafter, the injection of the oxygen-containing gas provides a low temperature oxidation or controlled oxidation process to cause molecular degradation and wherein the steam serves to prevent the temperature from rising above the temperature of the injected steam so as to establish the low temperature oxidation. That a low temperature oxidation did occur is seen by the fact that up to 0.3% CO and 6.2% $CO_2$ was present in the produced gas. The steam effectively controlled the temperature, so that a conventional in-situ combustion did not occur with its attendant much higher temperatures.

In a broad aspect of the invention a hydrocarbon-bearing formation containing a heavy crude or a tar sand containing bitumen is first traversed by at least one injection well and one production well. Fluid communication is established, for example, by the injection of air or nitrogen. Steam is then injected until breakthrough occurs at the production well and sufficient heat has been imparted to the formation to improve the mobility of the bitumen. Tests have shown that one pore volume of steam has been sufficient to transfer enough heat to the formation to impart the desired mobility. In some situations it may be desirable to fracture the formation and/or inject a solvent to further enhance the transmissibility of the formation.

Thereafter, a mixture of the oxygen-containing gas and steam is injected, such mixture being injected at a temperature corresponding to the saturation temperature for saturated steam at the pressure of the formation. The temperature of the mixture is preferably in the range of 250°-500° F. The oxygen-containing gas may be air, or a mixture of oxygen and non-condensible gases such as nitrogen, carbon dioxide or flue gas, or it may be substantially pure oxygen.

While the temperature of the mixture is preferred to be in the range of 250° to 500° F, this may be controlled by the temperature of the injected steam. Temperature levels may be realized by repressuring the formation to a pressure corresponding to that temperature of saturated steam in the desired temperature range. For example, the formation may first be repressured to about 300 psi so that the temperature of injected steam and oxygen-containing gas is approximately 420° F.

The mixture of the oxygen-containing gas and the steam is continued to be injected until the optimum amount of oxygen-containing gas has been injected. Preferably, the amount injected is in the range of from about 140 to about 200 standard pore volumes of gas at standard conditions. This optimum amount is expressed in standard condition, so that it is independent of reservoir temperature and pressure conditions. If it is desired to express the amount of gas injected, in terms of reservoir pore volumes, it can easily be calculated from a knowledge of reservoir temperature and pressure.

While experiments have shown this recited range to be optimum, we do not intend to be bound in this range, but rather the optimum range should be determined for the specific reservoir condition, by tests such as the laboratory tests described herein. Thereafter, the injection of the oxygen-containing gas is terminated, and injection of steam alone is continued until production of the fluids from the production well has declined below a reasonable production level.

It is within the scope of this invention to repeat the steps of steam injection, followed by injection of the mixture of steam and the oxygen-containing gas after production of the bitumen or oil has declined below a reasonable or economic level.

In summary, in accordance with this invention, enhanced recovery of heavy oils or bitumen is accomplished by the steps of: (1) the injection of steam, (2) injection of a mixture of an oxygen-containing gas and steam wherein the amount of the oxygen-containing gas injected until an optimum amount has been injected, and (3) injection of steam alone.

We claim:

1. A method for the recovery of hydrocarbons from a subterranean hydrocarbon-bearing formation traversed by at least one injection well and at least one production well and having fluid communication therebetween comprising the steps of;

a. injecting via said injection well steam until steam is produced at said production well, b. thereafter injecting via said injection well a mixture of steam and an oxygen-containing gas said mixture being injected at a temperature corresponding to the saturation temperature for saturated steam at the pressure of said formation whereby a low temperature oxidation is established in said formation until an optimum amount of said gas in the range of about 140 to 200 pore volumes at standard conditions has been injected simultaneously with said steam, c. terminating injection of said oxygen-containing gas and continuing injection of said steam, d. producing said hydrocarbons from said production well.

2. The method of claim 1 wherein said oxygen-containing gas is substantially pure oxygen.

3. The method of claim 1 wherein the oxygen-containing gas is air.

4. The method of claim 1 wherein the oxygen-containing gas comprises oxygen, nitrogen, carbon dioxide, flue gas and mixtures thereof.

5. The method of claim 1 wherein the temperature of said steam is in the range of about 250° F to 500° F.

6. The method of claim 1 wherein steps a) through c) are repeated after production has declined below a reasonable level at said production well.

7. The method of claim 1 wherein said hydrocarbon-bearing formation is first repressured to a pressure corresponding to a pressure of saturated steam at which the temperature of said saturated steam is in the range of 250° to 500° F.

* * * * *